US010016908B2

(12) United States Patent
Veis

(10) Patent No.: US 10,016,908 B2
(45) Date of Patent: Jul. 10, 2018

(54) LIQUID NITROGEN JET STREAM PROCESSING OF SUBSTRATES

(71) Applicant: HEWLETT-PACKARD INDUSTRIAL PRINTING LTD., Netanya (IL)

(72) Inventor: Alex Veis, Kadima (IL)

(73) Assignee: HP SCITEX LTD., Netanya (IL)

( * ) Notice: Subject to any disclaimer, the term of this patent is extended or adjusted under 35 U.S.C. 154(b) by 178 days.

(21) Appl. No.: 14/940,494

(22) Filed: Nov. 13, 2015

(65) Prior Publication Data

US 2016/0136834 A1 May 19, 2016

(30) Foreign Application Priority Data

Nov. 14, 2014 (EP) ..... 14193316

(51) Int. Cl.
*B26F 3/00* (2006.01)
*B26F 1/26* (2006.01)
(Continued)

(52) U.S. Cl.
CPC ..... *B26F 1/26* (2013.01); *B26D 3/085* (2013.01); *B26F 3/004* (2013.01); *B26F 3/008* (2013.01);
(Continued)

(58) Field of Classification Search
CPC ..... B26F 1/26; B26F 2003/006; B26F 3/004; B26F 3/008; B31B 2201/145;
(Continued)

(56) References Cited

U.S. PATENT DOCUMENTS 4,619,318 A 10/1986 Terrell et al.
4,693,153 A * 9/1987 Wainwright ..... B26F 3/004 239/433
(Continued)

FOREIGN PATENT DOCUMENTS

DE 10160275 A1 7/2003
FR 2647049 11/1990
(Continued)

OTHER PUBLICATIONS

FR 2703291 Machine translation, Oct. 1994.*
(Continued)

*Primary Examiner* — Stephen Choi
(74) *Attorney, Agent, or Firm* — HP Inc. Patent Department

(57) ABSTRACT

The present disclosure relates to processing a substrate including at least one sheet of paper, cardboard or carton by directing a jet stream of liquid nitrogen to a surface of the substrate via a jet nozzle; and by moving the jet nozzle at a distance from the surface. The jet stream can be unmodulated or modulated. For example, the jet stream can be modulated by a modulation unit such as to reduce the impact of the jet stream on the surface. In this way, the jet stream can be applied to score folding lines into the substrate. An unmodulated or on/off modulated jet stream can be applied to cut lines into the substrate. Thus, by applying an appropriate modulation to the jet stream, the processing can switch between cutting the substrate and scoring folding lines into the substrate.

16 Claims, 6 Drawing Sheets

(51) Int. Cl.

| | |
|---|---|
| ***B26D 3/08*** | (2006.01) |
| ***B31F 1/08*** | (2006.01) |
| *B31B 50/16* | (2017.01) |
| *B31B 50/20* | (2017.01) |
| *B31B 50/25* | (2017.01) |
| *B31B 50/88* | (2017.01) |
| *B31B 100/00* | (2017.01) |
| *B31B 110/35* | (2017.01) |

(52) U.S. Cl.
CPC ..... *B31F 1/08* (2013.01); *B26F 2003/006* (2013.01); *B31B 50/16* (2017.08); *B31B 50/20* (2017.08); *B31B 50/25* (2017.08); *B31B 50/88* (2017.08); *B31B 2100/00* (2017.08); *B31B 2100/0022* (2017.08); *B31B 2110/35* (2017.08); *Y10T 83/0591* (2015.04)

(58) Field of Classification Search
CPC ..... B31B 2201/147; B31B 2208/25; Y10T 83/0591; Y10T 83/2066; Y10T 83/2068; Y10T 83/364
See application file for complete search history.

(56) References Cited

U.S. PATENT DOCUMENTS

| | | | | |
|---|---|---|---|---|
| 5,456,629 | A | 10/1995 | Bingham | |
| 5,927,320 | A | 7/1999 | Pfarr | |
| 6,715,701 | B1 | 4/2004 | Julien | |
| 6,752,373 | B1 * | 6/2004 | Rudy | B05B 1/26 239/512 |
| 7,361,131 | B1 | 4/2008 | Abrott | |
| 2005/0066785 | A1 | 3/2005 | Kissell | |
| 2011/0232442 | A1 | 9/2011 | Guglielmetti et al. | |
| 2012/0137846 | A1 | 6/2012 | Quintard et al. | |
| 2014/0051334 | A1 * | 2/2014 | Raghavan | B24C 1/045 451/38 |

FOREIGN PATENT DOCUMENTS

| | | |
|---|---|---|
| FR | 2703291 | 10/1994 |
| GB | 2042398 A | 9/1980 |
| WO | WO-93/10950 | 6/1993 |

OTHER PUBLICATIONS

Dr.-Ing. J. Berkmanns et al., Laser Cutting, Laserline Technical, Jun. 18, 2008 (20 pages).
European Patent Office, Extended European Search Report for EP Appl. No. 14193316.8 dated Apr. 10, 2015 (6 pages).
https://web.archive.org/web/20140517173931/http://www.nitrocision.com—Liquid Nitrogen Cutting and Cleaning Complete Industrial-Grade Solutions dated on or before May 17, 2014 (2 pages).
https://web.archive.org/web/20141105072625/http://www.highcon.net—Highcon dated on or before Nov. 5, 2014 (2 pages).
www.piceramic.com—PICA Stack Piezo Actuators High Forces, High Displacement, Flexible Production, P-007-P-056 dated on or before Nov. 2, 2013 (2 pages).

* cited by examiner

LIQUID NITROGEN JET STREAM PROCESSING OF SUBSTRATES

CROSS REFERENCE TO RELATED APPLICATION

This application claims the benefit of EP Appl. No. 14193316.8, filed 14 Nov. 2014, which is hereby incorporated by reference.

BACKGROUND

Traditionally, printing and packaging materials such as paper, cardboards and cartons are processed to cut the substrate and/or to score the substrate with folding lines, depending on the printing and packaging material being produced. Thus, a cutting machine, such as for example a die cutter including cutting and scoring blades, is applied to cut and shape the printing and packaging material, whereas the substrate may also be scored with folding lines if the printing and packaging material is to be folded by a user.

BRIEF DESCRIPTION OF THE DRAWINGS

Examples of this disclosure are described with reference to the drawings which are provided for illustrative purposes, in which.

DETAILED DESCRIPTION

Analog die cutters can process large batches of printing and packaging materials, but have long setup times and are thus only designated for long run jobs. Traditional cutters using cutting tables and mechanical cutting blades can be adapted to cut thick boards and to structure almost any shape of cutting and folding lines, but generally require a large set of "puzzle" of blades. Hence, depending on the job, such sets of cutting blades must be provided and adapted to each different task, must be stored if the job is to be repeated, must be maintained, have a mechanically limited lifetime and require significant setup efforts. Hence, although such cutting machines allow fast processing, these machines can be very costly and complicated to handle. Alternatively, simpler cutting machines can be used for cutting packaging materials, for example by allowing only limited thickness of the material being cut. The use of cutting blades such as for example knifes generally requires significant cutting forces when cutting thicker materials. This results in short lifetime and high maintenance cost of the system. Non-contact systems, such as for example laser systems can cut cardboards or cartons but it is difficult to keep laser light focused in the cutting process when cutting thick printing and packing materials. For example, although it is possible to cut thin cartons using powerful CO2 lasers, laser focus difficulties prevent using such lasers to cut thick corrugated boards. Even at low numerical apertures, such as for example at 10*u* wavelength, the depth of focus will be in tens of microns range, which is insufficient to cut thick substrates. Moreover, laser systems are not suited for scoring folding lines into paper, cardboards and cartons. Fluid jet cutters can be used to cut different types of materials, such as for example metal sheets and the fluid can include abrasive particles and cooling fluids, such as for example metal particles and liquid nitrogen for treating hard and heat sensitive materials.

Figure 1:
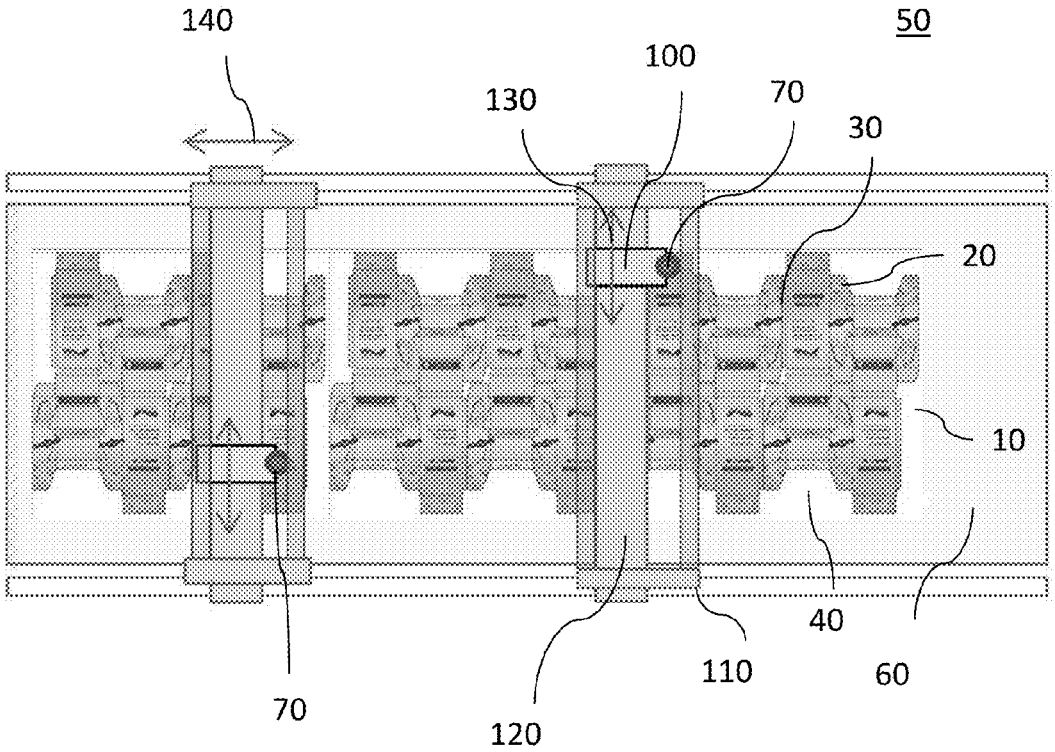
FIG. 1 shows a top view of an example of a jet system with two nozzles which are movable in the XY plane of a substrate.

According to one example, this disclosure provides a jet system for processing at least one sheet of paper, cardboard or carton. FIG. 1 shows an example of a corrugated cardboard 10 which is processed by a liquid jet system 50 with two nozzles 70 by cutting along cutting lines 20 such as to remove parts 40 of the cardboard 10. Moreover, parts of the corrugated cardboard 10 are to be scored along folding lines 30 such as to simplify folding of the corrugated cardboard 10. As a result, the corrugated cardboard 10 is processed to provide a plurality of foldable cardboard boxes.

In this example, the corrugated cardboard 10 has sufficient thickness to provide rigid boxes with strong walls. The cutting of thick corrugated cardboards 10 using mechanical cutting blades, such as for example knifes requires significant cutting forces which affect the lifetime and maintenance cost of the processing system. This is particularly the case when many corrugated cardboards 10 are tiled in the cutting device in a stacked arrangement for cutting a plurality of sheets in a single processing step.

Mechanical cutting blades have a body including and supporting a cutting edge, wherein the body must be strong enough to withstand the respective cutting force. Hence, the physical dimensions of mechanical cutting blades generally depend on the processing speed and the thickness and material properties of the substrate being cut. Thick or tiled corrugated cardboards 10 generally require stronger and thus larger mechanical cutting blades than thinner and single layered corrugated cardboards 10. However, although increased dimensions of mechanical cutting blades can improve the robustness of the system, it also affects the maneuverability required to arrange the cutting edge, for example in the process of following the cutting lines 20.

"Pizza" type roller cutters represent robust mechanical cutting blades comprising a circular body having a cutting edge provided along the circumference of the circular body. The circular body is rotatable about an axis such as to be rolled through the substrate being cut. Although this type of mechanical cutting blades can withstand and convey significant forces to the cutting edge, the mechanical cutting blades are adapted to roll along the cutting edge in a straight direction and are thus only suitable for cutting straight or only slightly curved lines. It follows that "Pizza" type roller cutters are not well suited for cutting curved and edged outlines of corrugated cardboard boxes such as for example illustrated in FIG. 1.

Another type of cutting systems controls the position of a mechanical cutting blade in the XY plane of the corrugated cardboard 10. In this respect, the XY plane of the corrugated cardboard 10 represent one of the flat surfaces of the corrugated cardboards 10 carrying the cutting and/or folding lines 20, 30. The mechanical cutting blade represents a knife or a mechanical saw which is mechanically arranged in the XY plane such as to apply a cutting force on the substrate 10. Thus, a mechanical actuator system is adapted to arrange the cutting blade such as to position the cutting blade in the XY plane of the corrugated cardboard 10, to turn by rotation the cutting blade into the desired cutting direction and to move the cutting blade in the Z direction towards and away from the corrugated cardboard 10 such as to initiate and interrupt cutting processes. Also in this example, the physical dimensions of the mechanical cutting blade are selected to cope with the processing speed and to withstand the cutting force applied to the substrate. Thus, the physical dimensions and strength of the mechanical cutting blade depends on the processing speed and the thickness and material properties of the substrate being cut. For example, in order to cut thicker or tiled corrugated cardboards 10, the dimensions of the mechanical blade must be adapted accordingly, which affects the maneuverability of the cutting edge, reduces processing speed, and increases wear and maintenance costs of the system.

Non-contact systems, such as for example laser systems can cut cardboards or cartons without mechanically rotating a cutting edge of a cutting blade for applying lateral cutting forces on a substrate. In contrast, laser systems direct a focused laser beam substantially perpendicular to the cutting surface of the substrate and thus burn cutting lines 20 into the paper, cardboard or carton 10. Thus, the laser beam can be directed in a flexible manner to follow complicated patterns of cutting lines 20, including edges and sharp curves. However, laser systems are costly, in particular for cutting large formats of paper, cardboards or cartons. Laser systems are also not suitable for cutting thick materials, such as for example stacked sheets of corrugated cardboards 10, in particular because it is difficult to keep laser light focused throughout thick substrates 10 to achieve a clean cutting effect and profile. Moreover, as laser systems are based on controlling the XY position of laser beams and burning cutting lines 20 into the cardboard or carton 10, such systems are not suited for scoring folding lines into a substrate 10.

Fluid jet cutters can cut different types of materials, such as for example metal sheets, and are based on directing a narrow jet stream containing a fluid towards the substrate 10 to be cut. The fluid can include abrasive particles, such as for example metal particles for improving the speed of processing and the outlines of the cutting profile. The fluid can also include cooling fluids, such as for example liquid nitrogen, such as to cool the processing area of the substrate 10, in particular for treating hard and heat sensitive materials. Traditionally, fluid jet cutters are applied to fluid resistant materials such as metals and plastic, because a jet stream of fluid is being directed to the material.

Figure 2:
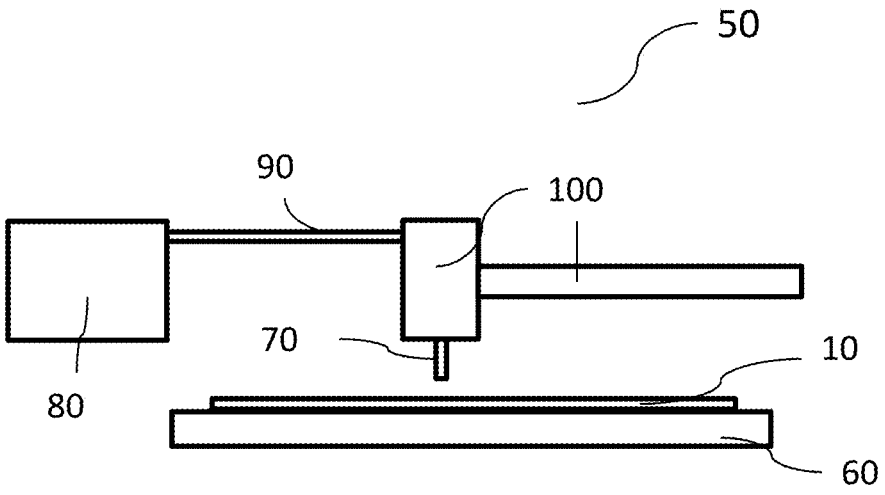
FIG. 2 shows an example of a jet system comprising a jet nozzle connected to a fluid container for processing paper, cardboards or cartons.

An example of a jet system 50 for processing at least one sheet of paper, cardboard or carton 10 is schematically illustrated in FIG. 2. Here, the jet system 50 includes a processing surface 60 supporting the respective substrate 10 being processed including at least one sheet of paper, cardboard or carton 10. The processing surface 60 can for example be made of metal or plastic or any other material suitable for supporting the substrate 10 during processing. The processing surface 60 can represent a surface of a movable conveyor belt which can support and move the at least one sheet of paper, cardboard or carton 10. The processing surface 60 can include vacuum channels for providing a vacuum between the processing surface 60 and the substrate 10 for fixing the at least one sheet of paper, cardboard or carton 10 during processing.

The jet system 50 illustrated in FIG. 2 further comprises at least one jet nozzle 70 and a fluid container 80. In this example, the fluid container 80 contains liquid nitrogen and is connected to the jet nozzle 70 via a fluid conductor 90 such as for example a pipe, tube, or hose that conveys the liquid nitrogen from the fluid container 80 to the jet nozzle 70. The fluid container 80 and fluid conductor 90 provide the jet nozzle 70 with liquid nitrogen having sufficient pressure for the jet nozzle 70 to direct a jet stream of liquid nitrogen to the sheet of paper, cardboard or carton 10. For this purpose, for example the fluid container 80 or fluid conductor 90 may include pumps, valves, or other devices required to provide the jet nozzle 70 with pressured liquid nitrogen. In this way, the jet nozzle 70 can provide a directed jet stream of liquid nitrogen for cutting the at least one sheet of paper, cardboard or carton 10. Lower pressures may be applied to score folding lines 30 into the substrate 10. The jet nozzle 70 may have different shapes and dimensions and may be arranged at different distances from the at least one sheet of paper, cardboard or carton 10. In the example illustrated in FIG. 2, the jet nozzle 70 is arranged at a distance of approximately 0.25 to 0.75 inches from the surface of the substrate 10, and the orifice of the jet nozzle 70 has a diameter of about 0.005 to 0.015 inches, although other dimensions of the orifice and distance to the surface can apply in accordance with the present disclosure. For example, the respective distance from the surface of the substrate 10 and the dimensions of the orifice of the jet nozzle 70 may depend on the pressure of the liquid nitrogen at the jet nozzle 70 and on the thickness and material characteristics of the substrate 10 being cut.

The jet system 50 illustrated in FIG. 2 further comprises a holding unit 100 which holds and moves the jet nozzle 70 at a distance from a surface of the at least one sheet of paper, cardboard or carton 10. In this way, the nozzle 70 directs a jet stream of liquid nitrogen to the substrate 10 and can be moved to cut or score lines into the at least one sheet of paper, cardboard or carton 10. In this example, the holding unit 100 represents a movable arm connected to actuators and is movable in the XY plane of the substrate 10 being processed, such as to maintain a predefined distance between the jet nozzle 70 and a surface of the at least one sheet of paper, cardboard or carton 10.

In another example, the holding unit 100 can also move the jet nozzle 70 to increase or decrease the distance between the jet nozzle 70 and a surface of the at least one sheet of paper, cardboard or carton 10. In this way, the impact of the jet stream on the surface of the substrate 10 can be reduced or increased by adjusting the distance between the jet nozzle 70 and substrate 10. For example, the distance between the jet nozzle 70 and substrate 10 can be adjusted to either cut or score the at least one sheet of paper, cardboard or carton 10.

In the example of a jet system 50 illustrated in FIG. 1, the jet system 50 comprises a bridge 110 including a slider 120 for holding the holding unit 100. Here, the holding unit 100 is slidable along the slider 120 of the bridge 110 in a first direction 130 at a predefined distance from the surface of the at least one sheet of paper, cardboard or carton 10. The bridge 110 including the slider 120 is slidable in a second direction 140 along the at least one sheet of paper, cardboard or carton 10 supported by the processing surface 60. In this way, the holding unit 110 holds and moves the jet nozzle 70 in the XY plane of the substrate 10 for cutting and/or scoring. In an example, the at least one sheet of paper, cardboard or carton 10 can be conveyed in the second direction 140 by a conveyor belt, wherein the processing surface 60 represents a surface of the conveyor belt. In this case, the cutting and/or scoring can be performed when the conveyor belt 60 is moving or stationary. If the conveyor belt is stationary during processing, the at least one sheet of paper, cardboard or carton 10 are loaded, cut and/or scored and unloaded in subsequent processing steps. In case the conveyor belt 60 is moving during processing, the loading and unloading of the at least one sheet of paper, cardboard or carton 10 can be performed simultaneously or separately, for example depending on the desired processing speed.

The nozzle 70 provides a jet stream of liquid nitrogen which is directed to for example cut or score lines 20, 30 into the paper, cardboard or carton 10. When the jet stream of liquid nitrogen impacts the paper, cardboard or carton 10 it is quickly vaporized due to heat development. Thus, the liquid nitrogen quickly changes from the state of liquid to vapor without depositing residual liquids on the paper, cardboard or carton 10. Thus, although a liquid jet stream is used to process fluid sensitive paper, cardboard or carton 10 the liquid nitrogen quickly vaporizes before any liquid damage is caused to the material being processed.

Moreover, the jet nozzle 70 directs the liquid nitrogen into a narrow jet stream which can cut paper, cardboard or carton 10 without significantly deflecting the jet stream travelling through the material. It follows that the narrow jet stream remains substantially undistorted throughout the cutting process and can thus be used to cut thick substrates 10, such as for example thick or stacked paper, cardboards or carton 10.

Figure 3:
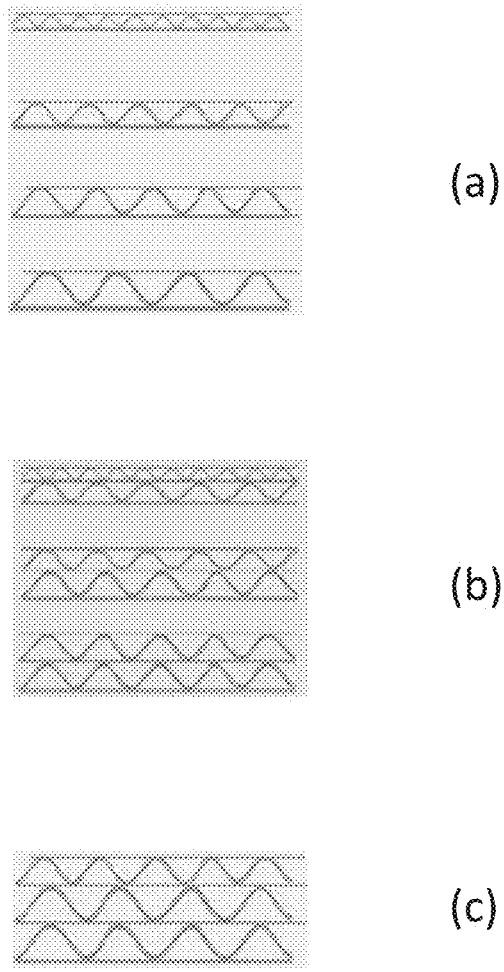
Fig. 3 (PRIOR ART)
FIG. 3 shows profiles of standard types of corrugated cardboards having different thicknesses and different number of layers.

FIG. 3 illustrates examples of corresponding profiles of single-face (a), double-face (b) and triple-wall (c) corrugated carton 10. For example, the single-face corrugated boards illustrated in FIG. 3(*a*) can be of standard E-, B-, C- or A-flute with thicknesses 1.1-1.9 mm, 2.1-3.0 mm, 3.2-3.9 mm and 4.0-4.8 mm respectively. The double-wall corrugated boards illustrated in FIG. 3(*b*) can for example be of standard EB-, BC- or CC-flute with thicknesses 4.06 mm, 6.5 mm or 7.33 mm. Further, the triple-wall corrugated board illustrated in FIG. 3(*c*) can for example be of AAC-flute standard with a thickness of 15 mm. The standard G-flute corrugated fiberboard represents a different applicable type of boards which is generally 1 mm or less thick. The surface of a G-flute corrugated fiberboard is smooth with approximately 180 stall stages per 30 cm, allowing for example offset printing directly on the surface. The stages of G-flute corrugated fiberboards and cardboards in general enhance the strength of the substrate and can thus reduce the amount of paper being used. In an example of the present disclosure, the jet stream of liquid nitrogen is used to cut single layered or stacked paper, cardboards or carton having thicknesses of more than 3 mm, 9 mm or 16 mm, to name a few examples. For example, 10 or 20 sheets of paper, cardboards or carton can be stacked and processed depending on the desired processing speed. Several passes may be required to cut very thick substrates, but for example 2 to 30 stacked cartons having a thickness of 15 mm or more can be cut in a single processing step using the liquid nitrogen jet stream without significantly impairing the cutting profile extending though the stack of cartons.

Hence, the liquid nitrogen jet stream allows fast processing, such as for example cutting and/or scoring of paper, cardboards or carton 10 without causing any liquid damage to the fluid sensitive material being cut. Moreover, paper, cardboards and cartons 10 can be stacked and processed in single cutting processes such as to improve efficiency and achieve fast processing. It is further possible to increase the number of jet nozzles 70 and holding units 100 to enable fast parallel processing. For example, FIG. 1 illustrates how two jet nozzles 70 work in parallel to cut cutting lines 20 and score folding lines 30 into a corrugated cardboard 10.

Thus, the cutting of at least one sheet of paper, cardboard or carton 10 using a jet stream of liquid nitrogen can provide a fast cutting process capable of processing stacks of substrates 10 in single processing steps. As mentioned above, substrates 10 can be supported and moved during the cutting process by a conveyor belt, wherein the processing surface 60 represent a surface of the conveyor belt. In an example, fast processing of a series of at least one sheet of paper, cardboard or carton 10 is achieved by moving the conveyor belt 60 at speeds of at least 0.10 m/s, 0.5 m/s or 5 m/s during processing of each of the substrates 10.

Depending on the thickness of the at least one sheet of paper, cardboard or carton 10 the holding unit may according to an example be moved at speeds of at least 20 mm/s, 35 mm/s or 50 mm/s relative to the surface of the substrate 10 being cut. However, the cutting lines 20 to be cut into the substrate 10 may represent non-connected lines which thus require that the process of cutting the paper, cardboard or carton 10 must be interrupted at high speed to move the jet nozzle 70 between two non-connected cutting lines 20. In other words, after processing one of the cutting lines 20 it may be required to temporarily interrupt the cutting process such as to move the jet nozzle 70 without cutting action to a different cutting line 20 and continue with the cutting process. The interruption of the cutting action may for example be performed by closing a valve or by turning off a pump in the fluid conductor 90 such as to interrupt the flow of liquid nitrogen to the jet nozzle 70. However, interrupting the liquid stream to the nozzle 70 by operating a pump or a valve in the fluid conductor 90 does not instantly cut the jet stream exiting the jet nozzle 70. As a matter of fact, the jet stream exiting the jet nozzle 70 decays depending on the buffer effect and pressure fall of the liquid nitrogen present in the fluid conductor 90 between the valve and jet nozzle 70. Consequently, when the jet nozzle 70 is moved at high speed during processing, the achievable speed of processing can depend on the time required to interrupt the liquid flow to the jet nozzle 70.

In a different example of this disclosure, a modulator unit 150 is provided to modulate the jet stream provided by the jet nozzle 70. In other words, the modulator unit 150 influences the jet stream exiting the jet nozzle 70 and is thus not subject to time constants induced by the fluid conductor 90. It follows that the modulation can be applied to quickly turn off and on the jet stream and thus to interrupt the cutting process of the at least one sheet of paper, cardboard or carton 10. During interruption of the jet stream, the jet nozzle 70 can be moved between two non-connected cutting lines 20 for further processing.

Figure 4:
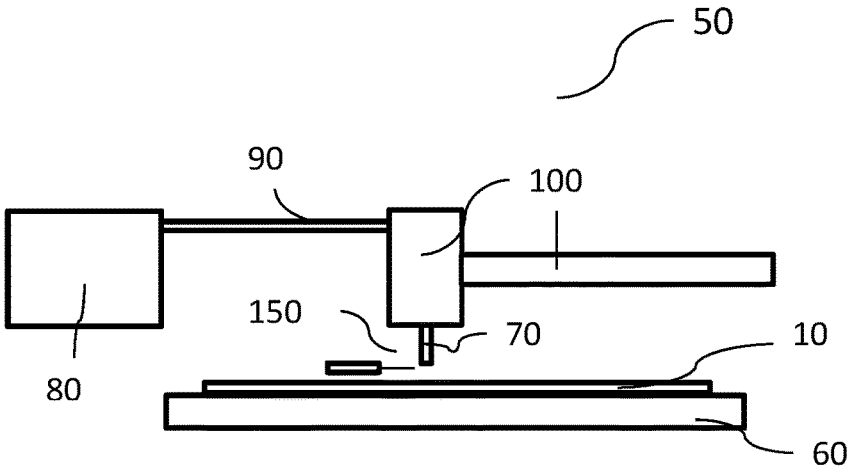
FIG. 4 shows an example of a jet system comprising a jet nozzle connected to a fluid container and a modulator unit.

FIG. 4 shows a corresponding example of a jet system 50 comprising at least one jet nozzle 70 connected to a fluid container 80 and a modulator unit 150 arranged at the outlet of the jet nozzle 70. More specifically, FIG. 4 illustrates a jet system 50 for processing a substrate 10 including at least one sheet of paper, cardboard or carton 10, wherein a processing surface 60 supports the substrate 10. In this example, the fluid container 80 contains liquid nitrogen which is conveyed to a jet nozzle 70 via a fluid conductor 90. Thus, the jet nozzle 70 is connected to the fluid container 80 for directing a jet stream of said liquid nitrogen to the at least one sheet of paper, cardboard or carton 10. A holding unit 10 is provided to hold and move the jet nozzle 70 at a distance from a surface of the at least one sheet of paper, cardboard or carton 10. It follows that the above discussed advantages of using liquid nitrogen for cutting fluid sensitive substrates 10 also apply for this example.

Figure 5:
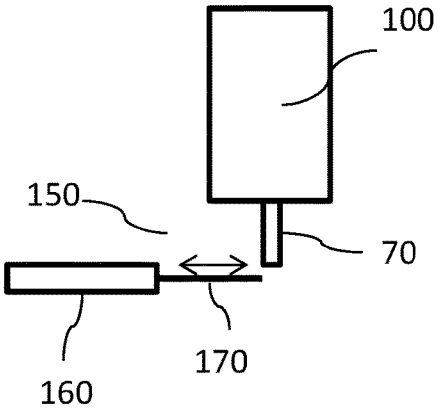
FIG. 5 shows an example of a modulator unit comprising an actuator and a distortion blade for modulating a jet stream.

Moreover, in this example, the modulator unit 150 is provided to modulate the jet stream directed by the jet nozzle 70. In other words, and as illustrated in FIG. 4, the modulator unit 150 is arranged at the outlet end of the jet nozzle 70 such as to influence and thus modulate the jet stream exiting the orifice of the jet nozzle 70. In an example, the modulator unit 150 comprises an actuator 160 and a distortion blade 170 wherein the distortion blade is moved relatively to the jet stream such as to distort and thus modulate the jet stream exiting the jet nozzle 70. As illustrated in an example according to FIG. 5, the actuator 160 moves the distortion blade 170 such as to distort the jet stream exiting the jet nozzle 70. For example, the actuator 160 can extend the distortion blade 170 into the jet stream until the jet stream is completely blocked from cutting or otherwise impacting the at least one sheet of paper, cardboard or carton 10. In other words, the mechanical movement of the distortion blade 170 causes the distortion blade 170 to block the jet stream exiting the jet nozzle 70 which is thus prevented from impacting the substrate 10. This movement can be quickly performed, such as for example by a piezo stack actuator 160 or by a moving coil actuator 160 connected to move the distortion blade 170. Consequently, the speed of modulation is independent from the time constants of the fluid connector 90 and can be applied to quickly turn off/on the jet stream exiting the jet nozzle 70 and thus to interrupt the cutting process of substrate 10. During interruption of the jet stream, the jet nozzle 70 can be moved between two non-connected cutting lines 20 for continuing the cutting process. Thus, quickly interrupting the jet stream can allow quick continuation of processing and thus fast processing speed.

In an example, the distortion blade 170 is made of a hard material such as for example metal, steel or diamond. This is for example useful if the pressure of the jet stream exiting the jet nozzle 70 requires a hard and resistant material for distorting the jet stream.

In an example, the distortion blade 170 is shaped and movable to only partially distort the jet stream exiting the jet nozzle 70. Consequently, only a part of the jet stream is prevented from impacting the substrate 10, wherein the remaining part of the jet stream has less impact and is applied to score folding lines 30 into the at least one sheet of paper, cardboard or carton 10.

In an example, a single distortion blade 170 is used to perform both the off/on modulation of the jet stream, and also to only partially distort the jet stream exiting the jet nozzle 70. For example, the actuator 160 may extend the distortion blade 170 into the jet stream such as to only partially distort the jet stream and thus enable scoring of the substrate 10. However, if the actuator 160 further extends the distortion blade 170 into the jet stream, such that the jet stream is prevented from impacting the substrate 10, an on/off modulation is provided. Thus, the modulator unit 150 comprising the single distortion blade 170 can switch between cutting and scoring the substrate 10, without requiring any additional tools or devices.

Figure 5A:
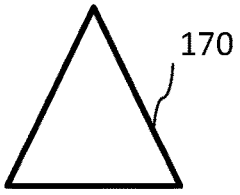
FIG. 5A shows an example of a distortion block having a triangular shape.

In an example, the distortion blade 170 has a flat surface such as to effectively block the jet stream by the flat surface with low deflection. In another example, as shown in FIG. 5A, the distortion blade 170 has a triangular shape, which may also be flat, wherein edges of the triangular shape can be applied to partially distort the jet stream exiting the jet nozzle 70. In this way, the edges of the triangular shape provide efficient and precise means for distorting the jet stream. For example, the tip of the triangular shape can be moved into the jet stream for generating minor distortions of the jet stream, whereas the triangular shape of the distortion blade 170 intensifies the distortion effect when the distortion blade 170 is moved further into the jet stream.

Figure 6:
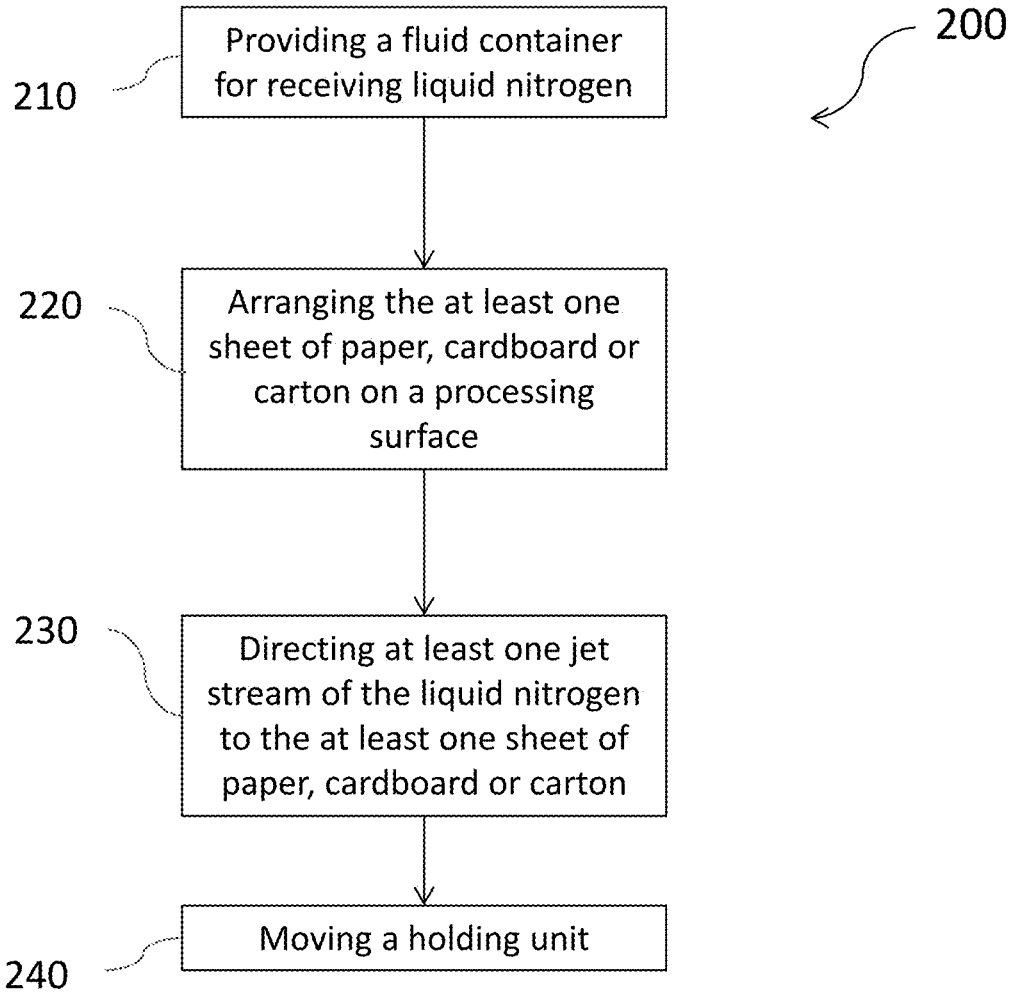
FIG. 6 shows an example of a method for processing paper, cardboards or cartons by directing a jet stream of liquid nitrogen.

An example of the present disclosure is illustrated in FIG. 6 and provides a method 200 of processing at least one sheet of paper, cardboard or carton. The method comprises providing 210 a fluid container for receiving liquid nitrogen and arranging 220 the at least one sheet of paper, cardboard or carton 10 on a processing surface 60. Then at least one jet stream of the liquid nitrogen is directed 230 to the at least one sheet of paper, cardboard or carton 10 via at least one jet nozzle 70, wherein the jet nozzle 70 is connected to the fluid container 80. Moreover, a holding unit 100 is moved 240, wherein the holding unit 100 holds the jet nozzle 70 at a distance from a surface of the at least one sheet of paper, cardboard or carton 10.

Thus, a jet stream of liquid nitrogen is directed via a nozzle 70 to process the at least one sheet of paper, cardboard or carton 10, wherein the at least one sheet of paper, cardboard or carton 10 is supported by a processing surface 220. When the jet stream of liquid nitrogen impacts the paper, cardboard or carton 10 the liquid nitrogen is quickly vaporized due to heat development. Thus, the liquid nitrogen quickly changes from the state of liquid to vapor without depositing residual liquids on the paper, cardboard or carton 10. It follows that although a liquid jet stream is used to process fluid sensitive paper, cardboard or carton 10 the liquid nitrogen quickly vaporizes before any liquid damage is caused to the material being processed.

In an example, moving the holding unit 100 comprises moving the holding unit 100 with a speed of at least 20 mm/s, 35 mm/s or 50 mm/s relative to the surface of the at least one sheet of paper, cardboard or carton 10.

Figure 7:
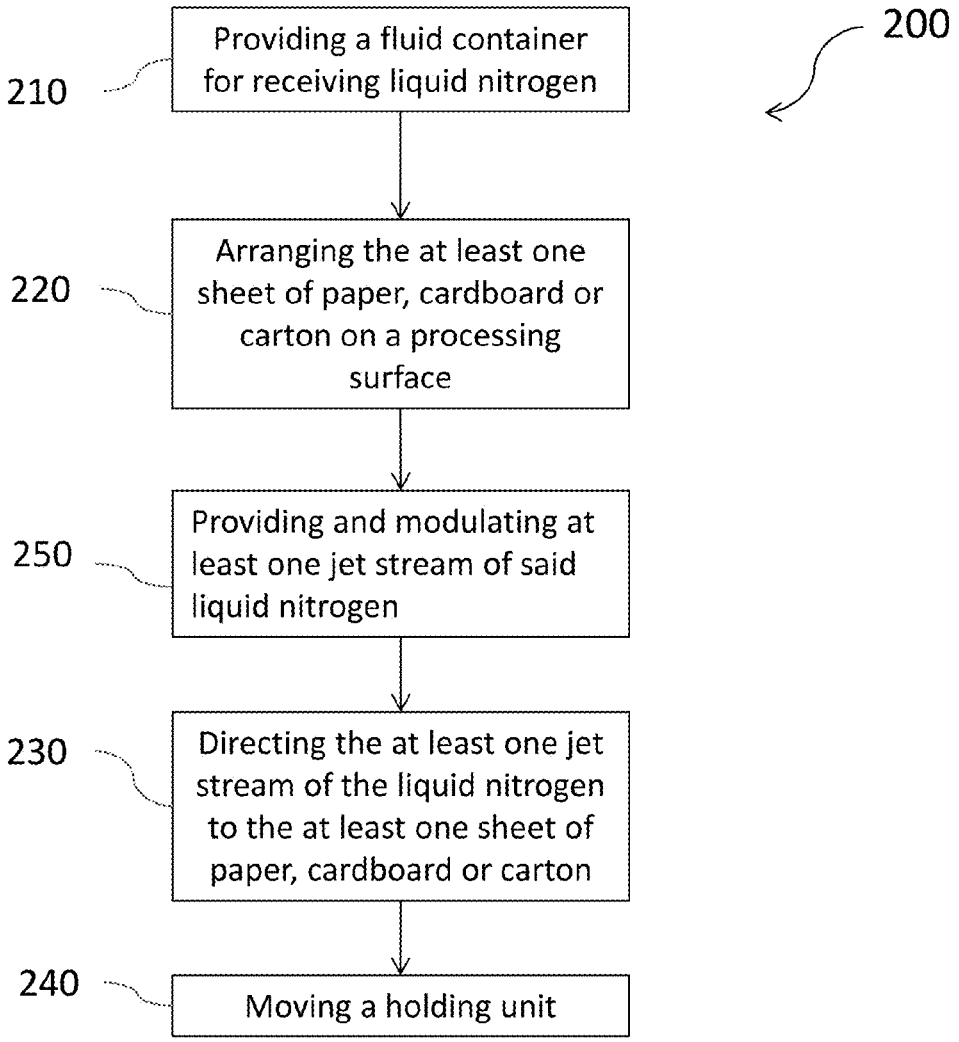
FIG. 7 shows an example of a method for processing paper, cardboards or cartons by directing a modulated jet stream of liquid nitrogen.

In a further example illustrated in FIG. 7, a method 200 is provided for processing at least one sheet of paper, cardboard or carton. The method includes providing 210 a fluid container 80 for receiving liquid nitrogen. The at least one sheet of paper, cardboard or carton 10 is arranged 220 on a processing surface 60. Then at least one jet stream of said liquid nitrogen is provided and modulated 250, wherein a jet nozzle 70 connected to the fluid container 80 directs 230 the modulated 250 jet stream of liquid nitrogen to the at least one sheet of paper, cardboard or carton 10. In other words, a modulated jet stream is directed by the jet nozzle 70 to the at least one sheet of paper, cardboard or carton 10 for cutting 20 and/or scoring folding lines 30 into the at least one sheet of paper, cardboard or carton 10. In this respect, the jet stream may for example be modulated 250 such as to reduce the impact of the jet stream to score folding lines 30 into the substrate. Alternatively, an on/off modulation may be applied wherein the modulation provides in time-intervals an unmodulated jet stream. In these time-intervals, an omission of modulation of the jet stream may be applied such as to allow full impact of the jet stream on the substrate 10, for example in order to cut the substrate 10. In this respect, FIG. 7 illustrates how the modulation 250 provides a modulated jet stream which is directed 230 to the at least one sheet of paper, cardboard or carton 10 via a jet nozzle 70.

Moreover, a holding unit 100 is moved 240, wherein the holding unit 100 holds the jet nozzle 70 at a distance from a surface of the at least one sheet of paper, cardboard or carton 10.

In an example, the respective modulation of the jet stream 250 is performed by moving a distortion blade 170 relative to the jet stream. In this respect, the jet stream is distorted by the distortion blade 170 for interrupting cut processing 20 of the at least one sheet of paper, cardboard or carton or for scoring folding lines 30 into the at least one sheet of paper, cardboard or carton 10.

What is claimed is:

1. A jet system comprising:

a processing surface to support a fluid sensitive substrate;

a fluid container to receive liquid nitrogen;

a jet nozzle connected to the fluid container for directing a jet stream of the liquid nitrogen to the fluid sensitive substrate supported by the processing surface;

an arm to hold and move the jet nozzle at a distance from a surface of the fluid sensitive substrate;

a moveable member; and an actuator to move the moveable member to modulate the jet stream directed by the jet nozzle, the actuator to move the moveable member to a first position relative to the jet nozzle to cut the fluid sensitive substrate, and the actuator to move the moveable member to a second position relative to the jet nozzle to partially distort the jet stream directed by the jet nozzle to score fold lines in the fluid sensitive substrate as the jet nozzle is moved relative to the fluid sensitive substrate while the moveable member is set to the second position, the second position different from the first position.

2. The jet system according to claim 1, further comprising a bridge including a slider for holding the arm, wherein the arm is slidable along the slider of the bridge in a first direction at the distance from the surface of the fluid sensitive substrate, the jet nozzle moved relative to the fluid sensitive substrate while the moveable member is set to the second position based on sliding of the arm along the slider of the bridge.

3. The jet system according to claim 1, wherein the arm is adjustable to increase or decrease the distance between the jet nozzle and the surface of the fluid sensitive substrate.

4. The jet system according to claim 1, wherein the fluid sensitive substrate comprises a stack of multiple fluid sensitive substrates, and wherein the modulating of the jet stream directed by the jet nozzle to score the fold lines comprises cutting through the stack of multiple fluid sensitive substrates to form multiple corresponding fold lines in each of the multiple fluid sensitive substrates.

5. The jet system according to claim 1, comprising a conveyor belt, wherein the processing surface includes a surface of the conveyor belt.

6. The jet system according to claim 5, wherein the conveyor belt is movable at a speed of at least 0.10 m/s, 0.5 m/s or 5 m/s during the cutting and the scoring of the fold lines in fluid sensitive substrate.

7. The jet system according to claim 1, wherein when the moveable member is at the first position, the jet stream has a greater impact on the fluid sensitive substrate than an impact of the jet stream on the fluid sensitive substrate when the moveable member is at the second position.

8. The jet system according to claim 1, wherein the moveable member comprises a blade.

9. The jet system according to claim 1, wherein the actuator is to move the moveable member to a third position relative to the jet nozzle to block the jet stream from impacting the fluid sensitive substrate, the third position different from each of the first and second positions.

10. The jet system according to claim 1, wherein the moveable member has a triangular shape.

11. A jet system comprising:

a processing surface to support a fluid sensitive substrate;

a fluid container to receive liquid nitrogen;

a jet nozzle connected to the fluid container for directing a jet stream of the liquid nitrogen to the fluid sensitive substrate supported by the processing surface;

an arm to hold and move the jet nozzle at a distance from a surface of the fluid sensitive substrate;

a moveable member; and an actuator to move the moveable member to modulate the jet stream directed by the jet nozzle, the actuator to move the moveable member to an on position relative to the jet nozzle to allow a first impact of the jet stream on the fluid sensitive substrate when cutting the fluid sensitive substrate, and the actuator to move the moveable member to a partially on position relative to the jet nozzle to partially distort the jet stream directed by the jet nozzle to allow a second impact of the jet stream on the fluid sensitive substrate when scoring the fluid sensitive substrate to form fold lines in the fluid sensitive substrate as the jet nozzle is moved relative to the fluid sensitive substrate while the moveable member is set to the partially on position, the second impact being less than the first impact.

12. The jet system according to claim 11, wherein the fluid sensitive substrate includes a stack of paper, cardboards or cartons or wherein the fluid sensitive substrate is at least 3 mm, 9 mm or 16 mm thick.

13. The jet system according to claim 11, wherein the moveable member comprises a distortion blade for modulating the jet stream by moving the distortion blade relative to the jet stream.

14. The jet system according to claim 11, wherein the actuator includes a piezo stack actuator or a moving coil.

15. The jet system according to claim 11, wherein the actuator is to move the moveable member to an off position relative to the jet nozzle to block the jet stream from impacting the fluid sensitive substrate.

16. The jet system according to claim 11, wherein the moveable member has a triangular shape.

* * * * *